US005603582A

United States Patent [19]

Loh

[11] Patent Number: 5,603,582

[45] Date of Patent: Feb. 18, 1997

[54] LINEAR CONNECTOR OF PLASTIC MATERIAL FOR JOINING TWO PARALLEL HOLLOW SPACING PROFILES OF MULTIPLE INSULATING GLASS UNITS

[75] Inventor: Walter Loh, Kaufbeuren-Neugablonz, Germany

[73] Assignee: CERA Handelsgesellschaft mbH, Ebenhofen, Germany

[21] Appl. No.: 412,904

[22] Filed: Mar. 29, 1995

[30] Foreign Application Priority Data

Mar. 30, 1994 [DE] Germany ..... 9405422 U

[51] Int. Cl.[6] ..... E06B 3/66

[52] U.S. Cl. ..... 403/298; 403/292; 49/504

[58] Field of Search ..... 403/298, 292, 403/389, 403; 49/504, 501; 160/381

[56] References Cited

U.S. PATENT DOCUMENTS 4,071,990 2/1978 Traber ..... 403/292 X
4,205,486 6/1980 Guarnacci ..... 49/504 X
4,296,587 10/1981 Berdan ..... 403/298 X
4,630,386 12/1986 Wilson ..... 403/403 X
5,154,531 10/1992 Peterson ..... 403/403 X

FOREIGN PATENT DOCUMENTS 3504880 1/1986 Germany ..... 49/504

*Primary Examiner*—Anthony Knight
*Attorney, Agent, or Firm*—Kalish & Gilster

[57] ABSTRACT

The invention relates to a linear connector of plastic material for joining two parallel hollow spacing profile tracks or hollow bar profile tracks of multiple insulating glass units used for windows to reduce heat loss from building interiors and forming the frame between two glass panes of such a multiple insulating glass unit and surrounding such glass unit, which frame having two ends which are to be connected to one another by the linear connector, characterized in that the linear connector includes two pairs of two distantly separated parallel legs extending in longitudinal direction of the spacing profile tracks of the frame which are to be connected to one another and being adjacent to an abutment rib extending accross these longitudinally extended legs, which abutment rib is provided with front faces being engaged by the front faces of the hollow profile spacing tracks if the linear connector is in mounted condition.

9 Claims, 1 Drawing Sheet

LINEAR CONNECTOR OF PLASTIC MATERIAL FOR JOINING TWO PARALLEL HOLLOW SPACING PROFILES OF MULTIPLE INSULATING GLASS UNITS

BACKGROUND OF THE INVENTION

The invention relates to a linear connector of plastic material for joining two parallel hollow spacing profiles or two parallel hollow bar profiles of multiple insulating glass units which units are provided at least two parallel glass panes separated from one another by such a spacing profile surrounding the edges of these glass panes.

Spacing profiles with parallel profile tracks for multiple insulating glass units are known for instance from the European patent specification 365 832. These spacing profiles are especially used in those cases in which the inner pan of the multiple insulating glass unit is heated as for instance in rooms of buildings. For that purpose a heat conductivity as low as possible as well as an electrical conductivity as low as possible of the spacing profiles are required, in order to avoid currence of heat or electricity, respectively, from the inner to the outer pan. Therefore, the two parallel tracks of the hollow spacing profiles are separated by suitable insulation, for instance by a molded mass of polyurethane joining these parallel tracks of spacing profiles to become a solid unflexible unit.

It has been found out that in those cases in which spacing profiles of the above-mentioned kind are not to be connected at their ends by so-called corner connectors but are to be connected within the straight range of their extension, because the spacing profiles need no corner connectors as they are continuously running around the four edges of the multiple insulating glass units, a linear connector is necessary provided with two parallel tracks forming a unitary construction. Such a unitary construction is advantageous because it can be mounted into the hollow spacing profiles, simpler and without less costs than two separate linear connectors. Moreover, such a construction using two parallel tracks as a unitary structure does not have the disadvantage that the location of connection of the spacing profiles is provided within the area of the isolating mass with an air gap which exists when two separate common linear connectors are used. The reason for such an air gap is the fact that the faces of the ends of the spacing profile tracks which are to be connected to one another abut the abutting ribs at the center of the linear connector. Thus, the point of connection of the spacing profile tracks which cut off together with the isolating mass located between them is provided with a gap within the range of the isolating mass, which gap corresponds to the thickness of these ribs of abutment.

SUMMARY OF THE INVENTION

It is therefore an object of the invention to improve the linear connector provided with two parallel tracks so that as between the spacing profile tracks a homogeneous connection can be gained without air gap.

It is a further object of the invention to manufacture the linear connector of a lesser quantity of plastic material without affecting negatively its function, i.e. especially its stability and its resistence against bending.

These and other objects of the invention are solved by a construction characterized in that the linear connector is provided with two pairs of two distantly arranged parallel legs extending in the longitudinal direction of the spacing profile track and being connected to one another by an abutment rib extending across the legs and being configured such that the front faces of the tracks of spacing profiles are in contact with that abutment rib when the linear connector is mounted into the corresponding hollow spacing profile tracks.

According to an advantageous embodiment of the invention the abutment rib can be configured such that it extends around the surface of the parallel legs of the linear connector forming between those legs a wall element the height of which is equal to or smaller than the greatest height of the cross-section of the legs. The abutment rib may have in this connection a thickness corresponding generally to the wall thickness of the hollow spacing profile tracks and may also have a height extending over the surface of the legs and corresponding also to the wall thickness.

Moreover, the legs can be structured as hollow bodies having a continuous hollow space which is not interrupted by the abutment rib and provided for the throughput of the hygroscopic material in the longitudinal direction of the legs from one spacing profile track to the joined other spacing profile track, which hygroscopic material absorbs the humidity of the gas, for instance air, within the space between the two glass panes.

Further advantageous embodiments of the invention are characterized by the claims.

DESCRIPTION OF THE DRAWINGS

A better understanding of the invention will be reached by reference to the following detailed description when read in conjunction with the accompanying drawings in which.

DESCRIPTION OF PREFERRED EMBODIMENT

Figure 1:
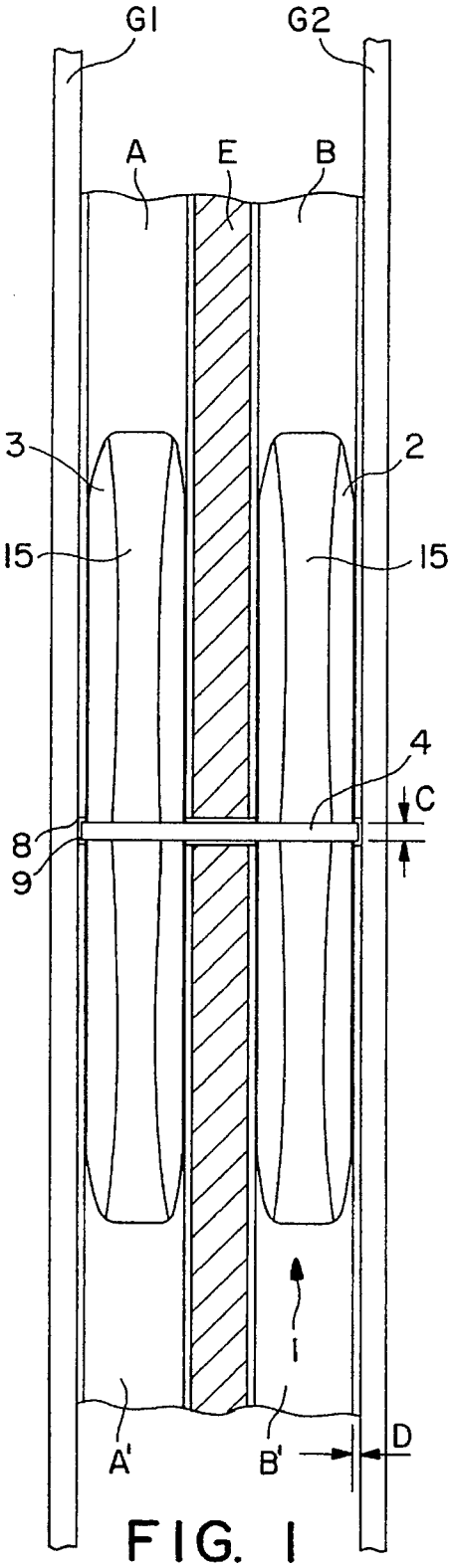
FIG. 1 is a schematical plan view of the linear connector provided with two parallel legs mounted in the two spacing profile tracks which are to be joined and which are shown in a longitudinal section enclosed in the space of two parallel glass panes of a multiple insulating glass unit.
Figure 4:
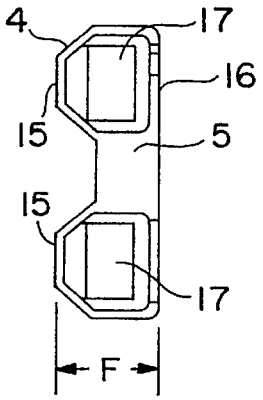
FIG. 4 is a front face view of the linear connector of FIGS. 2 and 3.
Figure 2:
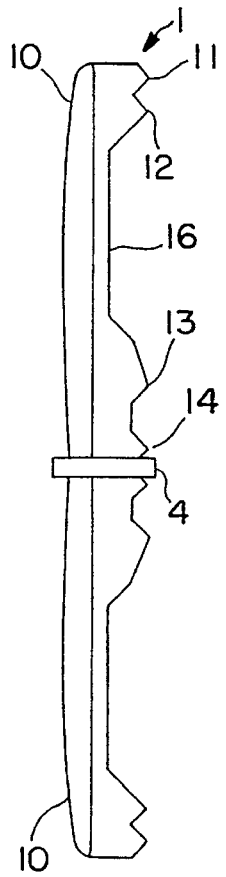
FIG. 2 is a schematical lateral view of the linear connector of FIG. 1 wherein the spacing profile tracks are deleted.
Figure 3:
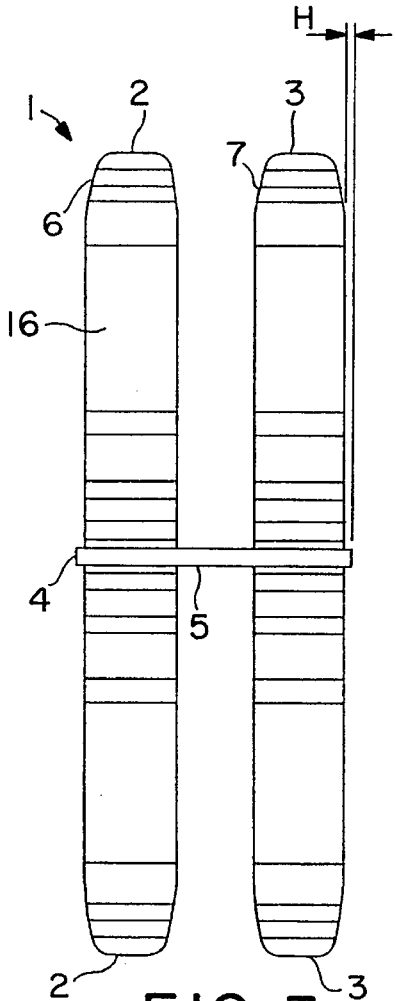
FIG. 3 is a schematical bottom view of the linear connector of FIG. 1

The linear connector 1 as shown in FIG. 1 of plastic material or metal is provided with two pairs of distantly separated parallel legs 2, 3 extending in longitudinal direction of two pairs of spacing profile tracks A, B and A', B', which are to be connected to one another by that linear connector. The spacing profile tracks are joined by a solid mass of plastic material E between them., The parallel legs 2, 3 are connected to one another as shown in FIGS. 1 and 3 by an abutment rib 4 extending across the longitudinal direction of the spacing profile tracks A, B and A', B' and across the legs 2, 3. The front faces 8, 9 of the spacing profile tracks A, B and A', B' are in contact with an abutment rib 4 in the hollow spacing profile tracks are connected to one another as shown in FIG. 1. The abutment rib 4 which can also be of plastic material or metal as the legs 2, 3 extends, as shown in FIGS. 2–4 around the surface of the parallel legs and forms between both legs a wall element 5 the height of which is smaller than the height F of the cross-section of the legs 2, 3 as shown in FIG. 4.

In FIG. 1 the two glass panes G1 and G2 between which the spacing profile tracks A, B and A', B' are arranged, which are joined in pairs by the longitudinal connector 1, are schematically and partly shown.

The thickness C of the abutment rib 4 is in the embodiment as shown a little bit greater than the thickness D of the wall of the hollow spacing profile tracks; it may also be, however, smaller. The height H by which the abutment rib extends beyond the surface of the legs 2, 3 corresponds, as shown in FIG. 3, to the thickness D of the wall of the hollow spacing profile tracks so that the surfaces of those tracks A, B and A', B' are in the mounted condition as shown in FIG. 1 within the area of connection of the tracks in general in the same level as the abutment rib 4.

The length of the legs 2, 3 can be chosen so that in general as shown in the drawings the legs should have the same length measured from the abutment rib. In order to simplify the insertion of the legs 2, 3 or the linear connector 1 as a whole, respectively, into the front face openings of the hollow spacing profile tracks, the outer ends 6, 7 of these legs taper conically. Thus also the upper surface of the linear connector tapers conically to the ends as shown at reference numeral 10 in FIG. 2.

The cross-section profile of the legs 2, 3 is in the shown embodiment conically configured as shown at numeral 15 in FIGS. 4, it could be, however, otherwise configured for adapting it to the cross-section of the spacing profile tracks.

The linear connector may be manufactured by an injection molding process, and the configuration of its lower side or bottom 16 is adapted to the respective purpose and could for instance be provided with ribs 11, 12, 13 and 14 extending across the legs and recesses therebetween, in order to decrease the weight of the connector as well as the mass of material neccessary for manufacturing it and to gain the requested elastic pressure between the surface of the linear connector and the surface of the wall of the surrounding hollow spacing profile tracks. Such an elastic pressure is neccessary in order to avoid that the front faces 8, 9 of the spacing profile tracks are separated from the abutment rib 4 and the legs 2, 3 do not slip out of the hollow spaces of the tracks.

Moreover, the legs 2, 3 can be hollow profile bodies as shown in the drawings provided with a continuous hollow space 17 not interrupted by the abutment rib 4 and forming a throughput channel for the hygroscopic material moving in longitudinal direction of the legs from one spacing profile track A or B to the connected adjacent one spacing profile track A' and B', respectively.

I claim:

1. Linear connector of plastic material for joining two parallel hollow spacing profile tracks or hollow bar profile tracks of multiple insulating glass units used for windows to reduce heat loss from building interiors and forming the frame between two glass panes of such a multiple insulating glass unit and surrounding such glass unit, which frame having two ends which are to be connected to one another by said linear connector, characterized in that the linear connector comprises two pairs of two distantly separated parallel legs extending in longitudinal direction of said spacing profile tracks of the frame which are to be connected to one another and being adjacent to an abutment rib extending across these longitudinally extended legs, which abutment rib is provided with front faces being engaged by the front faces of the hollow profile spacing tracks if the linear connector is in mounted condition, wherein the legs are hollow profile bodies provided with a continuous hollow space which is not interrupted by the abutment rib and let hygroscopic material freely run through said legs from one spacing profile track to the connected other spacing profile track.

2. Linear connector according to claim 1, wherein the abutment rib extends around the surface of the parallel legs.

3. Linear connector according to claim 1, wherein the abutment rib between the parallel legs provides a wall element the height of which is equal or smaller than the greatest height of the cross-section of the legs.

4. Linear connector according to claim 1, wherein the thickness of the abutment rib corresponds in general to the wall thickness of the hollow spacing profile tracks.

5. Linear connector according to claim 1, wherein the height by which the abutment rib extends beyond the surface of the legs corresponds to the wall thickness.

6. Linear connector according to claim 1, wherein the lengths of the legs measured from the abutment rib are equal.

7. Linear connector according to claim 1, wherein the outer ends of the legs are conically tapered.

8. Linear connector according to claim 1, wherein the legs are at least partly provided with a trapezoidal cross-section profile.

9. Linear connector according to claim 1, manufactured of plastic material or metal and by an injection molding process.

* * * * *